US011608256B1

(12) United States Patent
Hamlik et al.

(10) Patent No.: US 11,608,256 B1
(45) Date of Patent: Mar. 21, 2023

(54) CLAMP WITH REPLACEABLE WEAR SHOES

(71) Applicant: Rightline Equipment, Inc., Rainier, OR (US)

(72) Inventors: Jim D. Hamlik, Vancouver, WA (US); Joel D. Hamlik, Vancouver, WA (US)

(73) Assignee: Rightline Equipment, Inc., Rainer, OR (US)

( * ) Notice: Subject to any disclaimer, the term of this patent is extended or adjusted under 35 U.S.C. 154(b) by 410 days.

(21) Appl. No.: 16/714,783

(22) Filed: Dec. 15, 2019

Related U.S. Application Data

(60) Provisional application No. 62/780,254, filed on Dec. 15, 2018.

(51) Int. Cl.
*B66F 9/075* (2006.01)
*B66F 9/18* (2006.01)

(52) U.S. Cl.
CPC ..... *B66F 9/07504* (2013.01); *B66F 9/183* (2013.01)

(58) Field of Classification Search
CPC ..... B66F 9/07504; B66F 9/183
See application file for complete search history.

(56) References Cited

U.S. PATENT DOCUMENTS

| | | | | |
|---|---|---|---|---|
| 3,433,376 | A * | 3/1969 | Jordan | B66F 9/183 294/902 |
| 3,643,827 | A * | 2/1972 | Link | B66F 9/183 294/104 |
| 7,118,148 | B1 * | 10/2006 | Davis | B66F 9/183 294/902 |
| 10,280,056 | B1 * | 5/2019 | Davis | B66F 9/183 |
| 10,377,617 | B2 * | 8/2019 | Schindlbeck | B66F 9/183 |
| 2008/0063503 | A1 * | 3/2008 | Garrett | A01D 87/122 414/729 |
| 2018/0222734 | A1 * | 8/2018 | Bovo | B66F 9/22 |

* cited by examiner

*Primary Examiner* — Diem M Tran
(74) *Attorney, Agent, or Firm* — Rylander & Associates, PC; Philip R. M. Hunt

(57) ABSTRACT

A lift truck clamp assembly with replaceable wear elements. The clamp assembly comprises a clamp plate, a shoe plate, a plurality of wear elements, and one or more grip elements. The shoe plate is harder and more wear resistant than the clamp plate and is detachably coupled to a lower inside surface of the clamp plate. The wear elements are coupled to a bottom edge of the shoe plate and extend below the clamp plate. Through the shoe plate pass a plurality of grip element holes. Each grip element has a plateau and a lip. The lip is on a periphery of the grip element, surrounding the plateau. Each of the grip elements is positioned with the pad plateau protruding through one of the plurality of grip element holes, with the pad lip held between the shoe plate and the inside surface of the clamp plate.

26 Claims, 5 Drawing Sheets

20

CLAMP WITH REPLACEABLE WEAR SHOES

CROSS-REFERENCE TO RELATED APPLICATIONS

This application claims the benefit of U.S. Provisional Application No. 62/780,254, filed 2018 Dec. 15, incorporated herein by reference.

FIELD OF THE INVENTION

The present invention relates to cargo handling equipment. More particularly, the present invention relates to clamps for use primarily with lift trucks.

BACKGROUND

Material handling vehicles such as lift trucks are used to pick up and deliver loads between stations. A typical lift truck 10 has a mast 12, which supports a load-lifting carriage 14 that can be raised along the mast 12 (see FIG. 1). The carriage 14 typically has one or more carriage bars 16 to which a fork frame 18 is mounted. The carriage bars 16 are coupled to the mast in a way that allows the lift truck 10 to move the carriage bars 16 up and down, but not laterally relative to the truck. The fork frame 18 carries a pair of forks 20. An operator of the lift truck 10 maneuvers the forks 20 beneath a load prior to lifting it.

Instead of forks 20, a lift truck 10 may have a load clamp assembly 32 coupled to its mast 12 (See FIG. 2). The load clamp assembly 32 typically comprises a frame 40, one or more actuators 36 and two clamp arms 34. The actuators 36 are configured to move the clamp arms 34 toward or away from each other. The clamp arms 34 typically have a gripping material on the inside surfaces that contact the load. The gripping material, such as rubber or polyurethane, provides high friction contact surface for gripping the load and also provides a compressible and resilient contact surface to protect the load from superficial damage from the clamp arms 34. In use, the operator of the lift truck 10 approaches a load to be carried, such as a stack of cartons or a large appliance, such as a refrigerator. As the lift truck 10 approaches the load, the operator uses controls to open the gap between the clamp arms 34 wider than the load and may adjust the height of the clamp arms 34 so they will engage the load in a suitable location. The operator then maneuvers the lift truck 10 to straddle the load between the clamp arms 34. When the clamp arms 34 are positioned suitably around the load, the operator uses controls to bring the clamp arms 34 together, grasping the load. The operator then uses other controls to raise the load clamp assembly 32, raising the load off the floor, the load held between the clamp arms 34 by friction. The operator then drives the load to a desired location.

Load clamps, also known as carton clamps, are well known, but existing designs make it problematic for the clamps to grasp and lift loads on pallets. Pallets are typically made of wood and have hard, rough edges that wear or tear the gripping material on the inside surfaces of the clamp arms 34. The clamp arms 34 can be changed out for forks 20, but this takes time and is inconvenient if the loads to be moved are a mix of palleted and unpalleted loads.

BRIEF DESCRIPTION OF THE DRAWINGS

The present invention will be described by way of representative embodiments, illustrated in the accompanying drawings in which like references denote similar elements, and in which.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference. Herein, "left" and "right" are from the perspective of an operator of a lift truck when the operator is facing the fork frame. Herein, "lateral" refers to directions to the left or the right and "longitudinal" refers to a direction perpendicular to the lateral direction and to a plane defined by the fork frame.

Those skilled in the art will recognize that numerous modifications and changes may be made to the various embodiments without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the first embodiment is essential. Other embodiments are possible, their specific designs depending upon the particular application. As such, the scope of the invention should not be limited by the particular embodiments herein described but should be defined only by the appended claims and equivalents thereof.

Representative Embodiment—Structure

Figure 1:
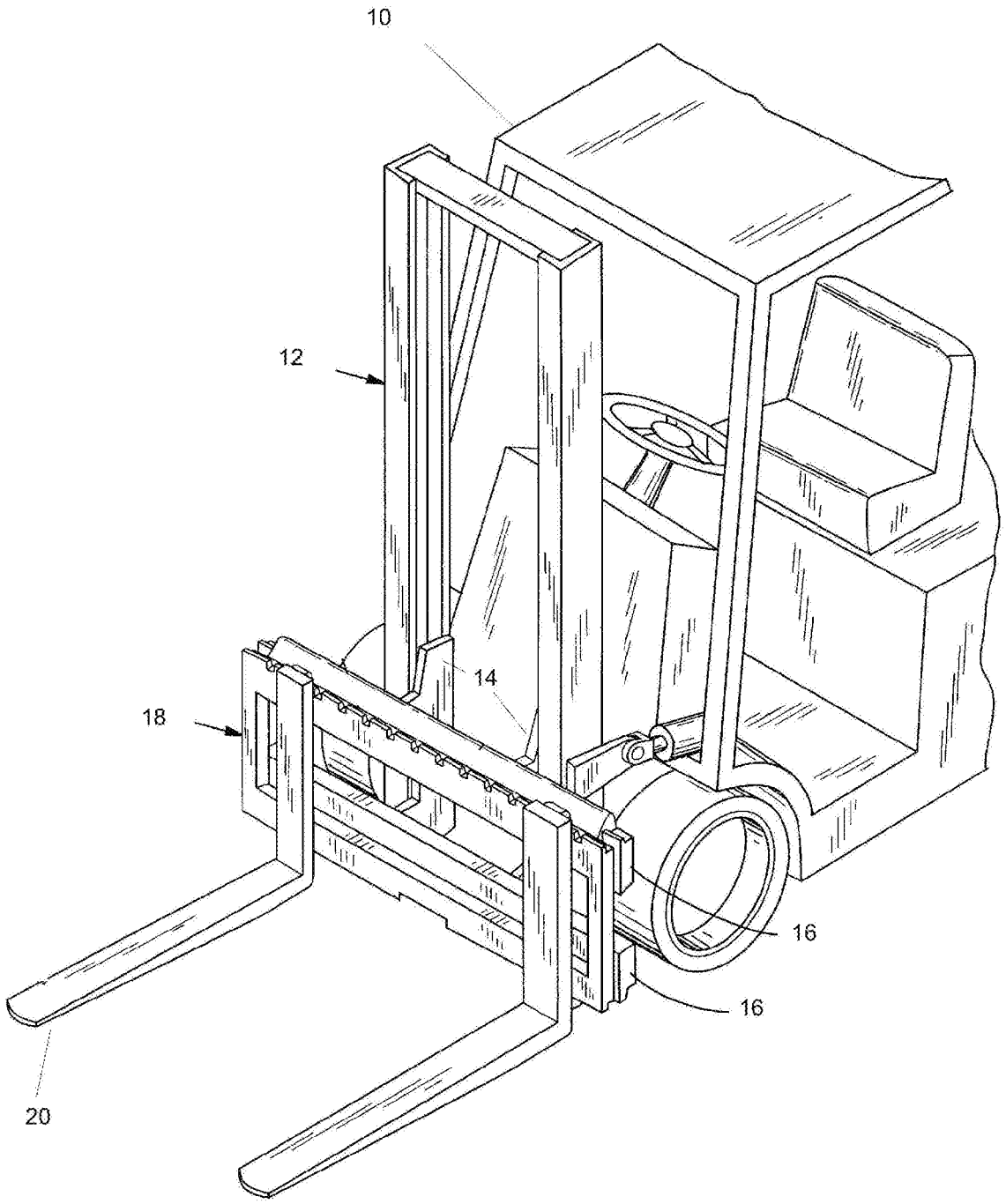
FIG. 1 (Prior Art)
FIG. 1 is an isometric view of a prior art lift truck, illustrating typical components of a lift truck equipped with forks.
Figure 2:
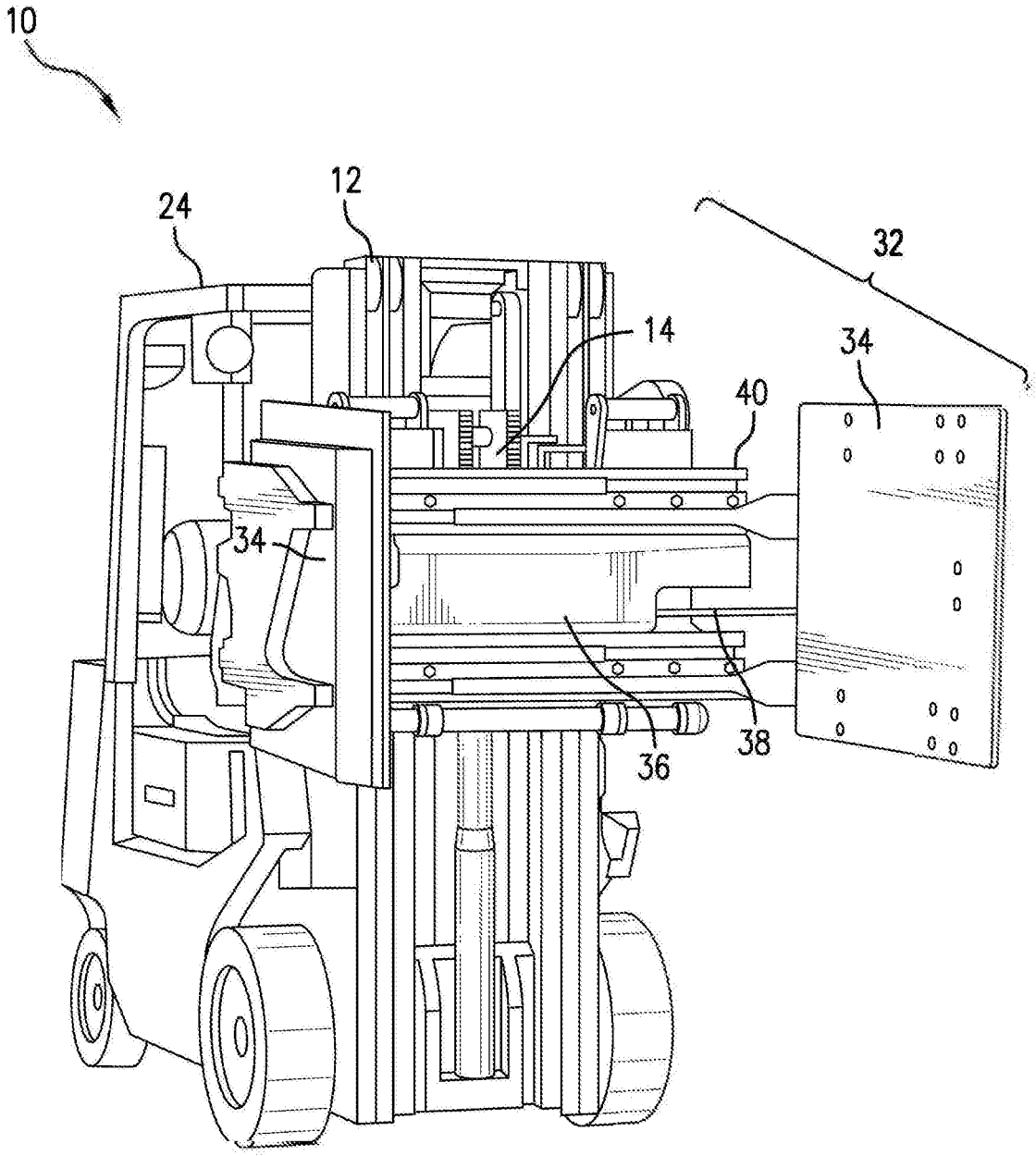
FIG.2 (Prior Art)
FIG. 2 is an isometric view of a prior art lift truck, illustrating typical components of a lift truck equipped with a load clamp assembly.
Figure 3:
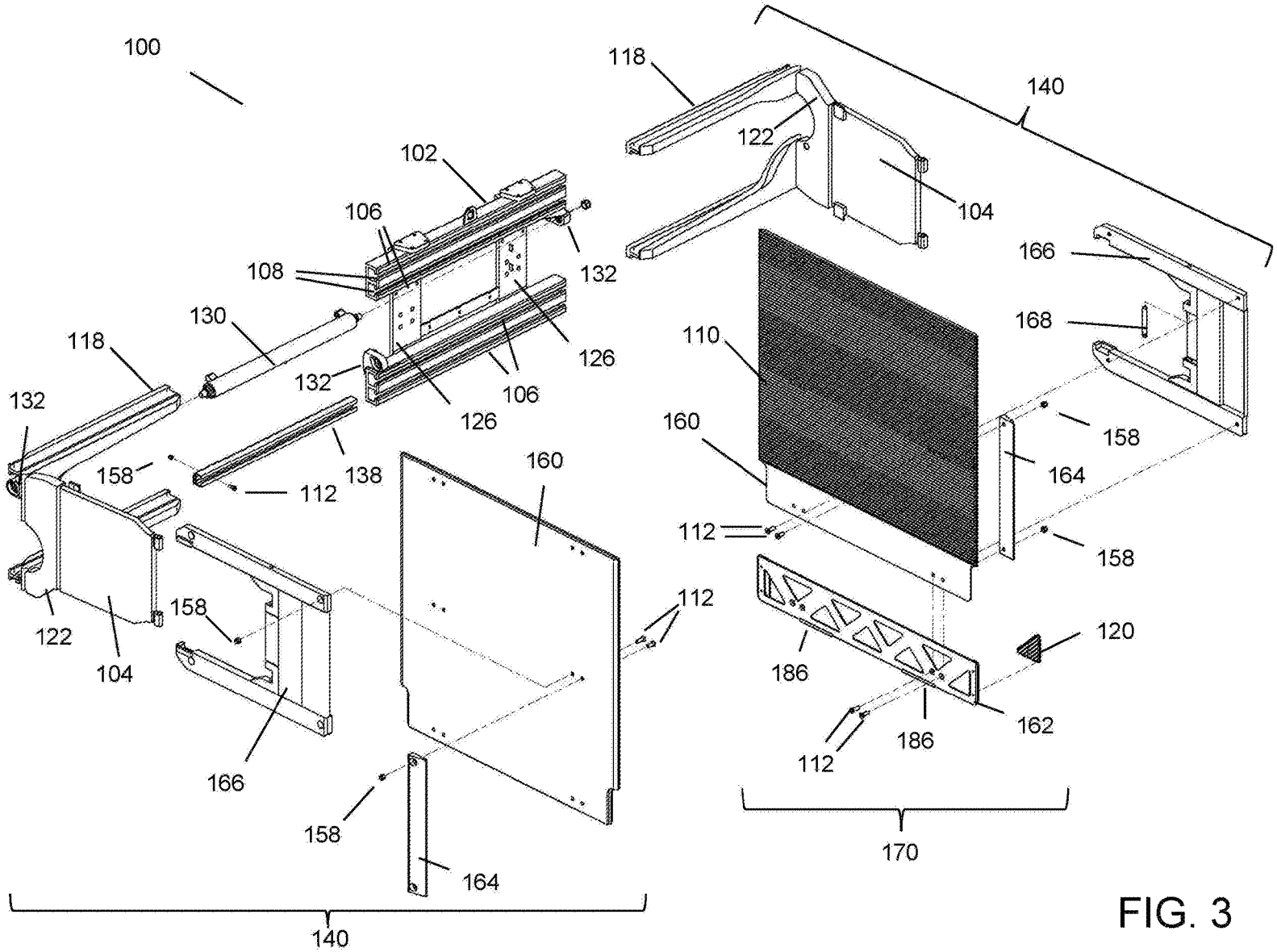
FIG. 3 is an exploded isometric front left view of a representative embodiment of a clamp assembly.

FIG. 3 is an exploded isometric front left view of a representative embodiment of a clamp assembly 100. The clamp assembly 100 comprises a frame 102, two clamp assemblies 140 and two actuators 130 (only one shown for clarity). Each actuator 130 is coupled to the frame 102 and to one of the two clamp assemblies 140. The actuators 130 are configured to pull the clamp assemblies 140 together or push them apart. The actuators 130 are further configured to act in tandem to provide a small amount of side shift to the two clamp assemblies 140, allowing an operator approaching a load a lift truck 10 to make a small adjustment lateral of the clamp assemblies 140 if the lift truck 10 is not perfectly lined up with the load. The maximum side shift from center line that can be provided this way is one half of the cylinder stroke of the actuators 130 (one actuator 130 fully retracted, the other actuator 130 fully extended).

The frame 102 is configured to be coupled to a carriage 14 of a lift truck 10. The frame 102 comprises four guide channels 106 coupled to two frame vertical beams 126, with two guide channels 106 positioned near a top of the frame 102 and two guide channels 106 positioned near the bottom of the frame 102. In the representative embodiment, the upper two guide channels 106 share a common channel wall and the lower two guide channels 106 are similar. However, in other embodiments, the guide channels 106 do not necessarily have common walls with adjacent guide channels 106. Two actuator brackets 132 are coupled to the frame 102, one coupled to a bottom one of a lower of the top two guide channels 106, and the other coupled to a top of an upper one of the bottom two guide channels 106. The upper actuator bracket 132 is position on the right of the frame 102 and the lower actuator bracket 132 is located on the left of the frame 102, when viewed from the front. The clamp assembly 100 is in a closed configuration when the clamp assemblies 140 are as close together as the actuators 130 can pull them. The clamp assembly 100 is in an open configuration when the clamp assemblies 140 are as far apart as the actuators 130 can push them.

Each of the guide channels 106 has a guide channel cavity 108. The guide channels 106 each have a guide channel slot on the front, opening to the guide channel cavity 108. Each guide channel 106 has a channel bearing 138, positioned inside the guide channel cavity 108 and shaped to conform to thereto, and with its own interior cavity that is similarly shaped, but slightly smaller. The channel bearing 138 is detachable coupled to the guide channel 106. In the first exemplary embodiment, the channel bearing 138 is detachably coupled to the guide channel 106 with a removable fastener scheme such as the cap screws 112 and nut 158 shown, but in other embodiments, other fastening schemes may be used. The channel bearings 138 comprise suitable bearing material that provides low friction and is softer than the components it has sliding contact with in order to preferentially wear. Since the channel bearings 138 are removable, they can be easily replaced when worn down.

Each clamp assembly 140 has a clamp plate assembly 170 coupled to a clamp sliding beam 118 via a clamp hinge plate 166, a clamp arm 104 and a clamp arm bracket 122. One of the two clamp sliding beams 118 is coupled to an actuator bracket 132, which couples the clamp assembly 140 to the actuator 130. The two clamp sliding beams 118 of each clamp assembly 140 are configured to slidingly fit into two of the guide channels 106 of the frame 102. The clamp hinge plate 166 is coupled to the clamp arm 104 with one or more hinge pins 168.

The clamp plate assembly 170 comprises a clamp pad 110, a clamp plate 160, a shoe plate 162, one or more shoe plate wear elements 186, and one or more grip elements 120. In some alternative embodiments, the clamp plate assembly 170 does not have any grip elements 120. In some alternative embodiments, the clamp plate assembly 170 does not have any shoe plate wear elements 186, as the shoe plate 162 itself serves as a replaceable wear element. The one or more grip elements 120 are detachably coupled to a lower portion of an inside surface of the clamp plate 160. The clamp plate 160 is configured for coupling to the clamp hinge plate 166. In the representative embodiment, the outside of the clamp plate 160 is coupled to the clamp hinge plate 166 with a plurality of cap screws 112 and nuts 158, but in other embodiments may be coupled by welding or other suitable joining mechanism. A clamp back bar 164 is coupled to the clamp plate 160 forward of the clamp hinge plate 166. The clamp pad 110 is coupled to an upper portion of the inside surface of the clamp plate 160, covering most of the inside surface of the clamp plate 160. The clamp pad 110 does not cover a lower portion of the inside surface of the clamp plate 160 where the shoe plate 162 and the one or more grip elements 120 attach. The clamp pad 110 comprises a high friction, compressible and resilient material, such as rubber or polyurethane. The clamp pad 110 may be grooved to improve friction and compressibility. The clamp pad 110 may have a surface pattern of contrasting colors to make it more visible and distinguishable when in proximity to a load. For example, in FIG. 3, the clamp pad has a surface pattern of horizontal light and dark bands. In other embodiments, other surface patterns, such as checkerboard may be used. The clamp plate 160 typically comprises aluminum, but may comprise other suitable materials.

Figure 4:
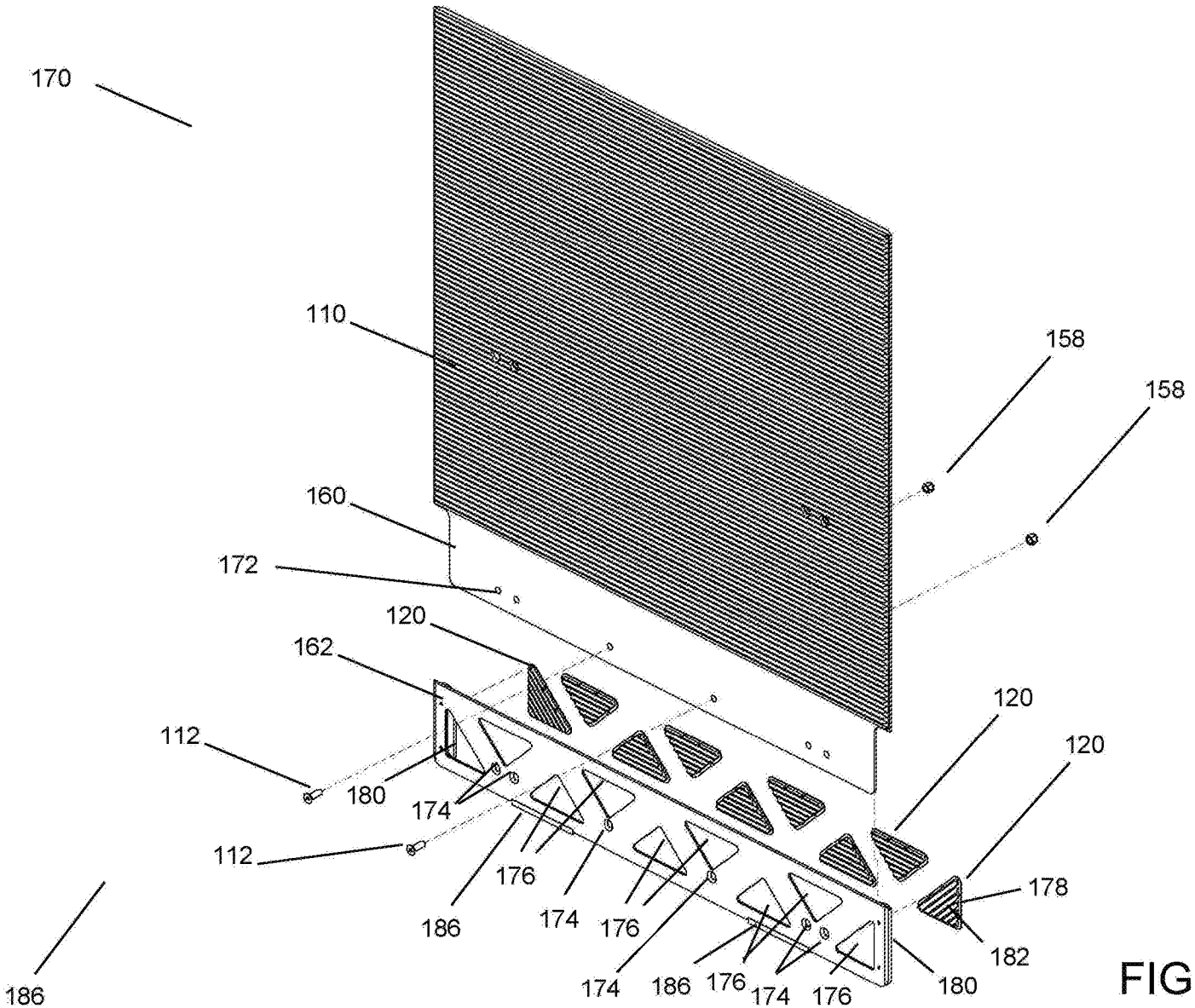
FIG. 4 shows an isometric exploded view of a clamp plate assembly.
Figure 5:
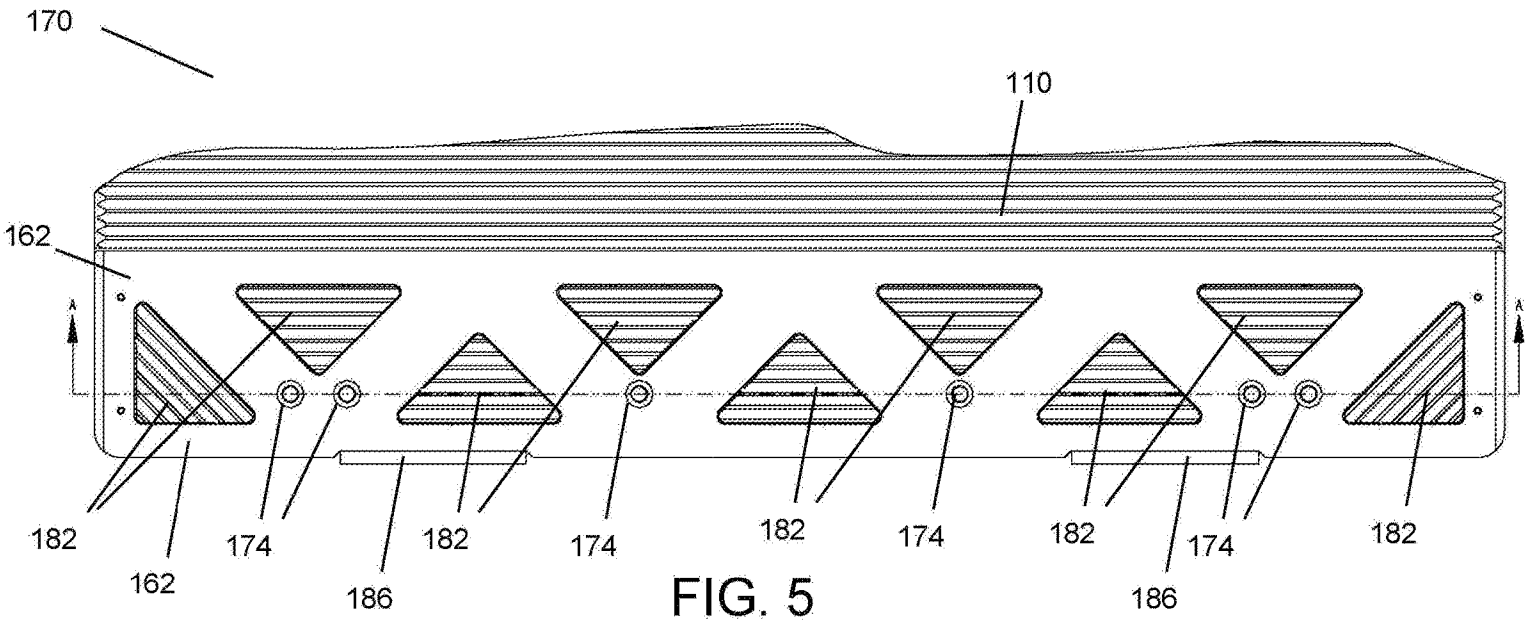
FIG. 5 shows a side view of the clamp plate assembly.
Figure 6:
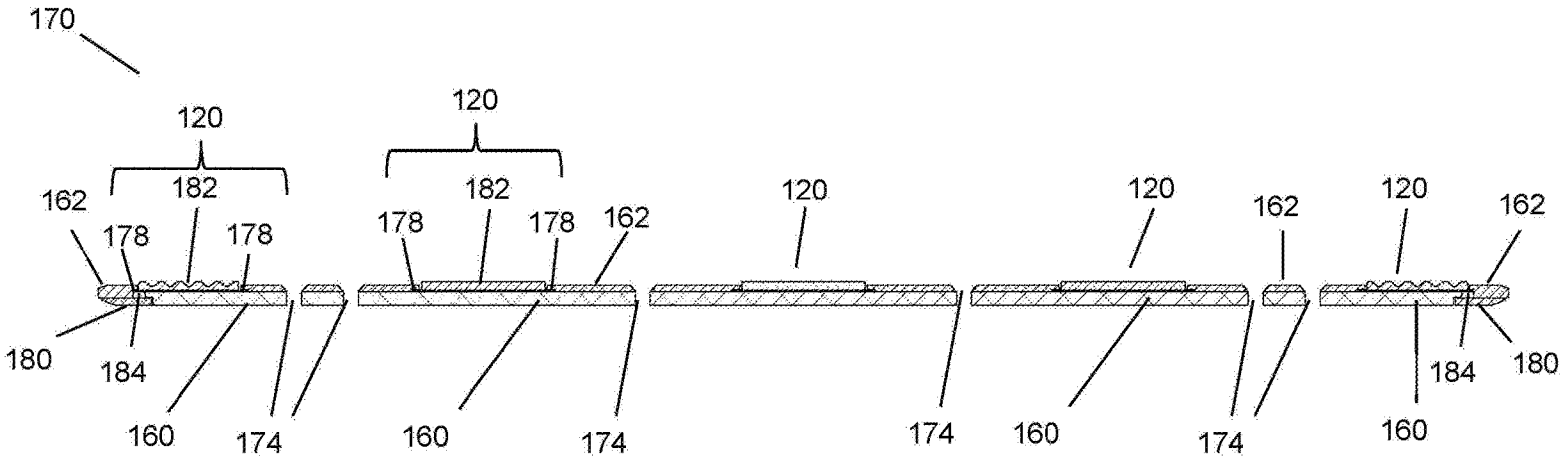
FIG. 6 shows a top sectional view of the clamp plate assembly along the A-A line in FIG. 5.

FIGS. 4-5 show views of the clamp plate assembly 170. The shoe plate 162 is detachably coupled to the clamp plate 160. One or more grip element holes 176 and a plurality of bolt holes 174 pass through the shoe plate 162. The bolt holes 174 may be countersunk to allow the cap screws 112 to fit flush with the surface of the shoe plate 162 so they do not contact or otherwise interfere with the load. Two shoe plate brackets 180 are coupled to an outer surface of the shoe plate 162, one on the forward-facing end of the shoe plate 162 and another on a rear-facing end of the shoe plate 162. The shoe plate bracket 180 has an overlapping portion that defines a shoe plate channel 184 between the shoe plate bracket 180 and the shoe plate 162. The shoe plate 162 is configured for accepting insertion of a lower edge of the clamp plate 160 shoe plate channel 184. The shoe plate brackets 180 assist in holding the shoe plate 162 to the clamp plate 160. In the representative embodiment, the shoe plate brackets 180 are coupled to the shoe plate 162 by welding, but in other embodiments may be coupled with other methods such as bolting. In yet other embodiments, the shoe plate brackets 180 are integrally formed as part of the shoe plate 162, such as by rolling the front and rear edges of the shoe plates 162 back towards each other. In yet other embodiments, one of the shoe plate brackets 180 is integrally formed as part of the shoe plate 162, with the other of the shoe plate brackets 180 coupled to the shoe plate 162. The shoe plate 162 typically are made of steel, which is harder and more wear-resistant than the aluminum that typically comprises the clamp plate 160, but the shoe plate 162 may comprise other suitable materials. In embodiments where the shoe plate 162 is made of materials harder and more wear-resistant than the clamp 160, the shoe plate 162 can itself serve as a wear element.

The grip element holes 176 are configured with a size and shape to accept insertion of the grip elements 120. In the representative embodiment, the grip element holes 176 and the grip elements 120 are triangular, but in other embodiments, may be another suitable shape, such as square or circular, or a mix of suitable shapes. In the representative embodiment, the grip element holes 176 are arranged in a pattern wherein each of the grip element holes 176 has at least one side that is adjacent and parallel to a side of an adjacent one of the grip element holes 176. However, other embodiments may have the grip element holes 176 arranged in other suitable patterns. The representative embodiment of the clamp plate assembly 170 has nine grip elements 120, but other embodiments may have more or fewer grip elements 120.

The shoe plate wear elements 186 are coupled to the bottom edge of the shoe plate 162 and serve as the main contact point between the shoe plate 162 and the floor, road or other surface upon which the load to be picked up rests. The shoe plate wear elements 186 are comprised of a hard material with high resistance to abrasion, such as Mangalloy, a steel alloy, containing 0.8 to 1.25% carbon, with 11 to 15% manganese. In other embodiments, other hard materials may be used. Mangalloy is very difficult to machine, so it would be impractical to make the entire shoe plate 162 from Mangalloy. Instead, the shoe plate wear element 186 is a smaller element attached to the shoe plate 162 and extending slightly below the lower edge of the shoe plate 162 and slightly below the lower edge of the clamp plate 160. In embodiments without wear elements 186, in which the shoe plate 162 itself serves as a wear element, the shoe plate 162 extends slightly below the lower edge of the clamp plate 160. Thus when the operator of the lift truck 10 drags a load across the floor with the clamp assembly 100 low enough to contact the floor, the shoe plate wear element 186 will most likely be the only point in contact with the floor and will be the part of the clamp assembly 100 that will most likely endure the most wear because of the dragging. Typically, the shoe plate wear element 186 is welded to the shoe plate 162. In some embodiments, the shoe plate wear element 186 may be a plate that is pinched between the shoe plate 162 and the clamp plate 160, thereby holding it in place. The shoe plate wear element 186 may be penetrated by one or more of the cap screws 112 that secure the shoe plate 162 to the clamp plate 160, helping to hold the shoe plate wear element 186 in place.

The grip elements 120, like the clamp pad 110, comprise a high friction, compressible and resilient material, such as rubber or polyurethane. In some alternative embodiments, the grip elements 120 comprise a hard material such as aluminum. In yet other embodiments, there are a plurality of grip elements 120, some comprising a first material such as rubber, others comprising a different material such as aluminum. The grip elements 120 may be grooved to increase compressibility and friction. Each of the grip elements 120 has a grip element plateau 182 and a grip element lip 178 along the periphery (edge) of the grip element plateau 182. The grip element lip 178 is configured to help secure the grip element 120 in place with respect to the shoe plate 162 and clamp plate 160. The grip element lip 178 is slightly larger than the grip element hole 176. When the plateau 182 of a grip elements 120 is inserted into a grip element hole 176, the grip element plateau 182 protrudes through the grip element hole 176, but the grip element lip 178 prevents the grip element 120 from passing completely through the grip element hole 176. The grip element lip 178 is held between the shoe plates 162 and the clamp plate 160. In the representative embodiment, the grip element lip 178 is continuous along the edge of the grip element 120, but in other embodiments it may be discontinuous, essentially a series of tabs.

Representative Embodiment—Operation

In action, the operator of a lift truck 10 opens the clamp assemblies 140 of the clamp assembly 100 and then moves the lift truck 10 towards a load on a pallet, with one clamp plate assembly 170 on each side of the load. The height of the carriage 14 is adjusted by the operator so that the shoe plates 162 of the clamp assembly 100 are at a height so they are opposite the pallet. The operator closes the clamp assemblies 140 until they securely engage the load, with the clamp plate assembly 170 engaging with and gripping the pallet. Usually, the grip elements 120 contact and grip the pallet. In some circumstances, if the size, position and pattern of the grip elements 120 are suitable and the alignment of the pallet is conducive, the grip element 120 may insert into gaps in the pallet and the shoe plate 162 contacts and grips the pallet. Once the clamp plate assembly 170 has securely engaged the pallet, the carriage 14 of the lift truck 10 is raised, along with the clamp assembly 100, the pallet and the load. The operator then drives the lift truck 10 to where the load is desired. The clamp pads 110 may engage the load and grip it, so that the clamp assembly 100 is gripping the load as well as the pallet. However, the clamp pads 110 typically do not engage the load, but serve as a guard rail to prevent the load from shifting off the pallet or tipping over as the lift truck 10 maneuvers. Alternatively, once the clamp plate assembly 170 has securely engaged the pallet, the operator may drive the lift truck in reverse without lifting the carriage 14. The shoe plate wear elements 186 of the clamp plate assemblies 170 drag along the floor or pavement, protecting the other components of the clamp plate assemblies 170 from wear.

The clamp plate assembly 170 is designed for easy replacement of the grip elements 120 and the shoe plate wear elements 186 when one or more become worn or damaged. Replacement of one or more of the grip elements 120 is cheaper than replacement of a pad that covers all of the interior surface of the clamp plate 160 and replacement of the shoe plate wear elements 186 is less expensive than replacement of shoe plate 162 or the clamp plate 160. The cap screws 112 and nuts 158 holding the shoe plate 162 to the clamp plate 160 are removed. Then the shoe plate 162 is slid down and off the lower end of the clamp plate 160. Some or all of the grip elements 120 and the shoe plate wear elements 186 may be removed from the shoe plate 162 and replaced with new grip elements 120 and shoe plate wear elements 186. Then the shoe plate 162 is slid onto the lower end of the clamp plate 160, with the lips 178 of the grip elements 120 pinched between the shoe plate 162 and the clamp plate 160. Portions of the shoe plate wear elements 186 are likewise held in place, pinched between the shoe plate 162 and the clamp plate 160. The cap screws 112 are inserted into the bolt holes 174 through bolt holes 172 in the clamp plate 160 and secured with the nuts 158, tightening to draw the shoe plate 162 to clamp plate 160, compressing the grip element lips 178 sufficiently to secure the grip elements 120 and the shoe plate wear elements 186.

What is claimed is:

1. A clamp assembly for a lift truck load handler comprising:

a clamp plate with an inside surface; and a shoe plate detachably coupled to a lower portion of the inside surface of the clamp plate, the shoe plate comprising one or more wear elements coupled to a bottom edge of the shoe plate, the wear elements harder and more wear-resistant than the clamp plate and the shoe plate, the wear elements extending below the clamp plate, wherein the shoe plate has a front shoe plate edge that wraps around a front edge of the clamp plate and partially covers an outside surface of the clamp plate.

2. A clamp assembly for a lift truck load handler comprising:

a clamp plate with an inside surface; and a shoe plate detachably coupled to a lower portion of the inside surface of the clamp plate, the shoe plate comprising one or more wear elements coupled to a bottom edge of the shoe plate, the wear elements harder and more wear-resistant than the clamp plate and the shoe plate, the wear elements extending below the clamp plate, wherein the shoe plate has a rear shoe plate edge that wraps around a rear edge of the clamp plate and partially covers an outside surface of the clamp plate.

3. The clamp assembly of claim 2, wherein the shoe plate has a front shoe plate edge that wraps around a front edge of the clamp plate and partially covers an outside surface of the clamp plate.

4. A clamp assembly for a lift truck load handler comprising:

a clamp plate with an inside surface;

a shoe plate detachably coupled to a lower portion of the inside surface of the clamp plate, the shoe plate comprising one or more wear elements coupled to a bottom edge of the shoe plate, the wear elements harder and more wear-resistant than the clamp plate and the shoe plate, the wear elements extending below the clamp plate; and a front shoe plate bracket coupled to the shoe plate defining a front shoe plate channel between the front shoe plate bracket and the shoe plate, wherein a lower front edge of the clamp plate is inserted into the front shoe plate channel.

5. A clamp assembly for a lift truck load handler comprising:

a clamp plate with an inside surface;

a shoe plate detachably coupled to a lower portion of the inside surface of the clamp plate, the shoe plate comprising one or more wear elements coupled to a bottom edge of the shoe plate, the wear elements harder and more wear-resistant than the clamp plate and the shoe plate, the wear elements extending below the clamp plate; and a rear shoe plate bracket coupled to the shoe plate defining a rear shoe plate channel between the rear shoe plate bracket and the shoe plate, wherein a lower rear edge of the clamp plate is inserted into the rear shoe plate channel.

6. The clamp assembly of claim 5, a front shoe plate bracket coupled to the shoe plate defining a front shoe plate channel between the front shoe plate bracket and the shoe plate, wherein a lower front edge of the clamp plate is inserted into the front shoe plate channel.

7. The clamp assembly of claim 6, wherein the shoe plate brackets are integrally formed as part of the shoe plate.

8. A clamp assembly for a lift truck load handler comprising:

a clamp plate with an inside surface;

one or more grip elements detachably coupled to a lower portion of the inside surface of the clamp plate;

a shoe plate detachably coupled to a lower portion of the inside surface of the clamp plate, with one or more grip element holes in the shoe plate, each grip element hole passing through the shoe plate; and wherein each of the one or more grip elements has a grip element plateau and a grip element lip, wherein the grip element lip is on a periphery of the grip element, wherein each of the grip elements is positioned with the grip element plateau protruding through one of the one or more grip element holes and with the grip element lip held between the shoe plate and the inside surface of the clamp plate.

9. The clamp assembly of claim 8, wherein the one or more grip elements are sized and positioned on the clamp plate for inserting into gaps in a standard pallet, allowing the shoe plate to contact and grip the standard pallet.

10. The clamp assembly of claim 8, wherein one or more grip elements and the one or more grip element holes are triangular in shape.

11. The clamp assembly of claim 10, wherein the grip element holes are arranged in a pattern wherein each of the grip element holes has at least one side that is adjacent and parallel to a side of an adjacent one of the grip element holes.

12. The clamp assembly of claim 8, wherein each of the grip elements comprises a high friction material.

13. The clamp assembly of claim 8, wherein each of the grip elements comprises a compressible and resilient material.

14. The clamp assembly of claim 8, wherein the one or more grip elements are a plurality of grip elements, some of the grip elements comprising a first material, others of the grip elements comprising a second material different from the first material.

15. A clamp assembly for a lift truck load handler comprising:

a clamp plate; and a shoe plate detachably coupled to a lower portion of an inside surface of the clamp plate, the shoe plate is harder and more wear-resistant than the clamp plate, wherein the shoe plate extends below the clamp plate, wherein the shoe plate has a front shoe plate edge and a rear shoe plate edge that respectively warp around a front clamp plate edge and a rear clamp plate edge and each partially covering an outside surface of the clamp plate.

16. A clamp load handler for a lift truck comprising:

a frame;

left and right actuators coupled to the frame; and left and right clamp assemblies, each slidingly coupled to the frame and coupled to the respective actuator, wherein each clamp assembly has a clamp arm and a clamp plate coupled to the clamp arm, wherein each clamp assembly has a shoe plate detachably coupled to a lower portion of an inside surface of the clamp plate, the shoe plate comprising one or more wear elements coupled to a bottom edge of the shoe plate, the wear elements harder and more wear-resistant than the clamp plate and extending below the clamp plate, wherein each shoe plate has a front shoe plate edge that wraps around a front edge of the clamp plate and partially covers an outside surface of the clamp plate.

17. The clamp assembly of claim 16, wherein the shoe plate is harder and more wear-resistant than the clamp plate.

18. The clamp assembly of claim 16, wherein each shoe plate has a rear shoe plate edge that wraps around a rear edge of the clamp plate and partially covers an outside surface of the clamp plate.

19. A clamp load handler for a lift truck comprising:

a frame;

left and right actuators coupled to the frame; and left and right clamp assemblies, each slidingly coupled to the frame and coupled to the respective actuator, wherein each clamp assembly has a clamp arm and a clamp plate coupled to the clamp arm, wherein each clamp assembly has a shoe plate detachably coupled to a lower portion of an inside surface of the clamp plate, the shoe plate comprising one or more wear elements coupled to a bottom edge of the shoe plate, the wear elements harder and more wear-resistant than the clamp plate and extending below the clamp plate, wherein each clamp assembly has a front shoe plate bracket coupled to the shoe plate defining a front shoe plate channel between the front shoe plate bracket and the shoe plate, wherein a lower front edge of the clamp plate is inserted into the front shoe plate channel.

20. The clamp assembly of claim 19, wherein each clamp assembly has a rear shoe plate bracket coupled to the shoe plate defining a rear shoe plate channel between the rear shoe plate bracket and the shoe plate, wherein a lower rear edge of the clamp plate is inserted into the rear shoe plate channel.

21. The clamp assembly of claim 20, wherein the shoe plate brackets are integrally formed as part of the shoe plate.

22. A clamp load handler for a lift truck comprising:

a frame;

left and right actuators coupled to the frame;

left and right clamp assemblies, each slidingly coupled to the frame and coupled to the respective actuator, wherein each clamp assembly has a clamp arm and a clamp plate coupled to the clamp arm, wherein each clamp assembly has a shoe plate detachably coupled to a lower portion of an inside surface of the clamp plate, the shoe plate comprising one or more wear elements coupled to a bottom edge of the shoe plate, the wear elements harder and more wear-resistant than the clamp plate and extending below the clamp plate;

wherein each shoe plate has one or more grip element holes, each grip element hole passing through the shoe plate; and wherein each clamp assembly has one or more grip elements detachably coupled to a lower portion of an inside surface of the clamp plate, wherein each clamp assembly has one or more grip elements, each grip element having a grip element plateau and a grip element lip, wherein the grip element lip is on a periphery of the grip element, wherein each of the grip elements is positioned with the grip element plateau protruding through one of the one or more grip element holes and with the grip element lip held between the shoe plate and an inside surface of the clamp plate.

23. The clamp load handler of claim 22, wherein each of the grip elements comprises a high friction material.

24. The clamp load handler of claim 22, wherein the shoe plate is detachably coupled to a portion of the clamp plate near a bottom of the clamp plate.

25. The clamp load handler of claim 22, further comprising:

one or more wear elements coupled to a bottom edge of the shoe plate, the wear elements harder and more wear-resistant than the shoe plate and the clamp plate and extending below the clamp plate.

26. The clamp load handler of claim 25, wherein each wear element comprises mangalloy.

* * * * *